US010906622B1

(12) United States Patent
Boks et al.

(10) Patent No.: US 10,906,622 B1
(45) Date of Patent: Feb. 2, 2021

(54) TROLLING MOTOR AND MOUNT FOR TROLLING MOTOR

(71) Applicant: Brunswick Corporation, Mettawa, IL (US)

(72) Inventors: Michael J. Boks, Grand Rapids, MI (US); John Witte, Ada, MI (US)

(73) Assignee: Brunswick Corporation, Mettawa, IL (US)

( * ) Notice: Subject to any disclaimer, the term of this patent is extended or adjusted under 35 U.S.C. 154(b) by 124 days.

(21) Appl. No.: 16/154,217

(22) Filed: Oct. 8, 2018

(51) Int. Cl.
*B63H 20/10* (2006.01)
*B63H 21/17* (2006.01)
*B63H 20/00* (2006.01)

(52) U.S. Cl.
CPC ..... *B63H 20/10* (2013.01); *B63H 20/007* (2013.01); *B63H 21/17* (2013.01)

(58) Field of Classification Search
CPC ..... B63H 20/106; B63H 20/10; B63H 20/007
See application file for complete search history.

(56) References Cited

U.S. PATENT DOCUMENTS 3,895,276 A 7/1975 Brown et al.
4,033,530 A 7/1977 Harris
4,305,012 A 12/1981 Friedel
4,911,398 A 3/1990 Dilulio et al.
4,966,566 A 10/1990 Baird
4,995,839 A 2/1991 Havins
5,017,165 A 5/1991 Havins
5,081,947 A 1/1992 Holden
5,277,630 A 1/1994 Clark
5,607,136 A 3/1997 Bernloehr
7,004,804 B2 2/2006 Bernloehr et al.
7,056,166 B2 6/2006 Bernloehr
7,195,526 B2 3/2007 Bernloehr et al.
7,285,029 B1 10/2007 Janitz
7,722,417 B2 5/2010 Bernloehr et al.
(Continued)

OTHER PUBLICATIONS

Saint-Gobain Performance Plastics, "Norglide PTFE Sliding Bearings," website, available at https://www.bearings.saint-gobain.com/solution/norglide, website accessed Jul. 23, 2018.
(Continued)

*Primary Examiner* — Andrew Polay
(74) *Attorney, Agent, or Firm* — Andrus Intellectual Property Law, LLP

(57) ABSTRACT

A trolling motor includes a head unit, a propulsion unit, and a shaft coupling the head unit to the propulsion unit. A shaft support couples the shaft to a mount base, which may be coupled to watercraft's deck. The shaft support is pivotable with respect to the mount base to move the trolling motor between a deployed position and a stowed position with respect to the deck. The trolling motor further includes a spring and damper combination coupled between the mount base and the shaft support, wherein a spring portion of the spring and damper combination provides a spring force to assist in pivoting the shaft support away from the deck, and a damper portion of the spring and damper combination provides a damping force to slow pivoting of the shaft support towards the deck and/or a metal-reinforced, self-lubricating bearing pivotably coupling the shaft support to the mount base.

20 Claims, 10 Drawing Sheets

(56) References Cited

U.S. PATENT DOCUMENTS

| | | | | |
|---|---|---|---|---|
| 9,296,455 | B2 | 3/2016 | Bernloehr et al. | |
| 9,969,474 | B1 | 5/2018 | Truax et al. | |
| 2006/0116031 | A1* | 6/2006 | Bernloehr ..... | B63H 20/007 440/6 |

OTHER PUBLICATIONS

Wikipedia, "Polytetrafluoroethylene," web article, available at https://en.wikipedia.org/wiki/Polytetrafluoroethylene, website accessed Jul. 23, 2018.

Johnson Outdoors Marine Electronics, Inc., "Minn Kota Fortrex Bow-Mount Trolling Motor," user manual, Jan. 2017.

Dictator Technik GMBH, "Gas Springs," Catalog, Jan. 2016.

Boks et al., "Trolling Motor and Mount for Trolling Motor," Unpublished U.S. Appl. No. 16/046,235, filed Jul. 26, 2018.

Industrial Gas Springs, "Damped Gas Springs and Dampers," website, 2018, available at https://www.industrialgassprings.com/damped-gas-springs-and-dampers/.

* cited by examiner

TROLLING MOTOR AND MOUNT FOR TROLLING MOTOR

FIELD

The present disclosure relates to trolling motors and mounts for coupling trolling motors to watercraft in a manner that allows the trolling motor to be pivoted between a stowed position and a deployed position.

BACKGROUND

U.S. Pat. No. 4,911,398, which is incorporated herein by reference in entirety, discloses an apparatus for mounting an outboard trolling motor to a boat for movement of the motor between a horizontal stowed position and a vertical operating position, including a track-mounted carriage which supports the motor for reciprocal movement along a horizontal boat surface, such as a deck, and a pivoting mechanism at the end of the track to tilt the motor and its mounting to a vertical operating position. The pivotal mechanism may comprise a curved track section coextensive with the horizontal track, or a split carriage mechanism in which the motor mounting portion is pivotable with respect to the track engaging carriage portion through the operation of a rack and pinion mechanism at the end of the track.

U.S. Pat. No. 7,285,029, which is incorporated herein by reference in entirety, discloses a support device for a trolling motor that is attachable to an arm of the trolling motor to provide a cushion between the arm and a deck surface of a boat. This cushion inhibits bouncing of the arm of the trolling motor in response to a boat traveling over rough water or being trailered from one location to another over roads. The support device is attachable to the arm of the trolling motor without additional fasteners, such as screws or clips. It is also movable to different positions along the length of the arm of the trolling motor, thus allowing more than one support device to be attached to the trolling motor mount.

Unpublished U.S. patent application Ser. No. 16/046,235, filed Jul. 26, 2018, which is incorporated herein by reference in entirety, discloses a mount for a trolling motor that pivots the trolling motor between a deployed position and a stowed position. The mount includes a base coupled to a deck of a watercraft and upper and lower arms pivotably coupled to the base. A bracket also couples the upper arm to the lower arm. The mount includes one of the following: (1) a deployed-position latch coupled to the upper arm or the base and a corresponding deployed-position striker pin configured to engage with the deployed-position latch in the deployed position of the trolling motor to lock the upper arm to the base; or (2) a pivotable latch and an associated latch blocker on the upper or lower arm or the base and a corresponding striker pin configured to engage with the pivotable latch in the deployed and/or stowed position of the trolling motor to lock the upper or lower arm to the base.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a trolling motor includes a head unit, a propulsion unit, and a shaft coupling the head unit to the propulsion unit. A mount base is configured to be coupled to a deck of a watercraft. A shaft support couples the shaft to the mount base. The shaft support is pivotable with respect to the mount base to move the trolling motor between a deployed position and a stowed position with respect to the deck. The trolling motor further comprises at least one of the following: (a) a spring and damper combination coupled between the mount base and the shaft support, wherein a spring portion of the spring and damper combination provides a spring force to assist in pivoting the shaft support away from the deck, and a damper portion of the spring and damper combination provides a damping force to slow pivoting of the shaft support towards the deck; and (b) a metal-reinforced, self-lubricating bearing pivotably coupling the shaft support to the mount base.

According to another example of the present disclosure, a mount for coupling a trolling motor to a deck of watercraft is configured to pivot the trolling motor between a deployed position and a stowed position with respect to the deck. The mount comprises a base configured to be coupled to the deck; an upper arm having a first end pivotably coupled to a first end of the base; and a lower arm having a first end pivotably coupled to the base between the first end of the base and an opposite, second end of the base. A bracket couples an opposite, second end of the upper arm to an opposite, second end of the lower arm. A spring and damper combination is coupled between one of the upper or lower arm and the base. A spring portion of the spring and damper combination provides a spring force to assist in lifting the one of the upper or lower arm away from the deck, and a damper portion of the spring and damper combination provides a damping force to slow lowering of the one of the upper or lower arm towards the deck.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
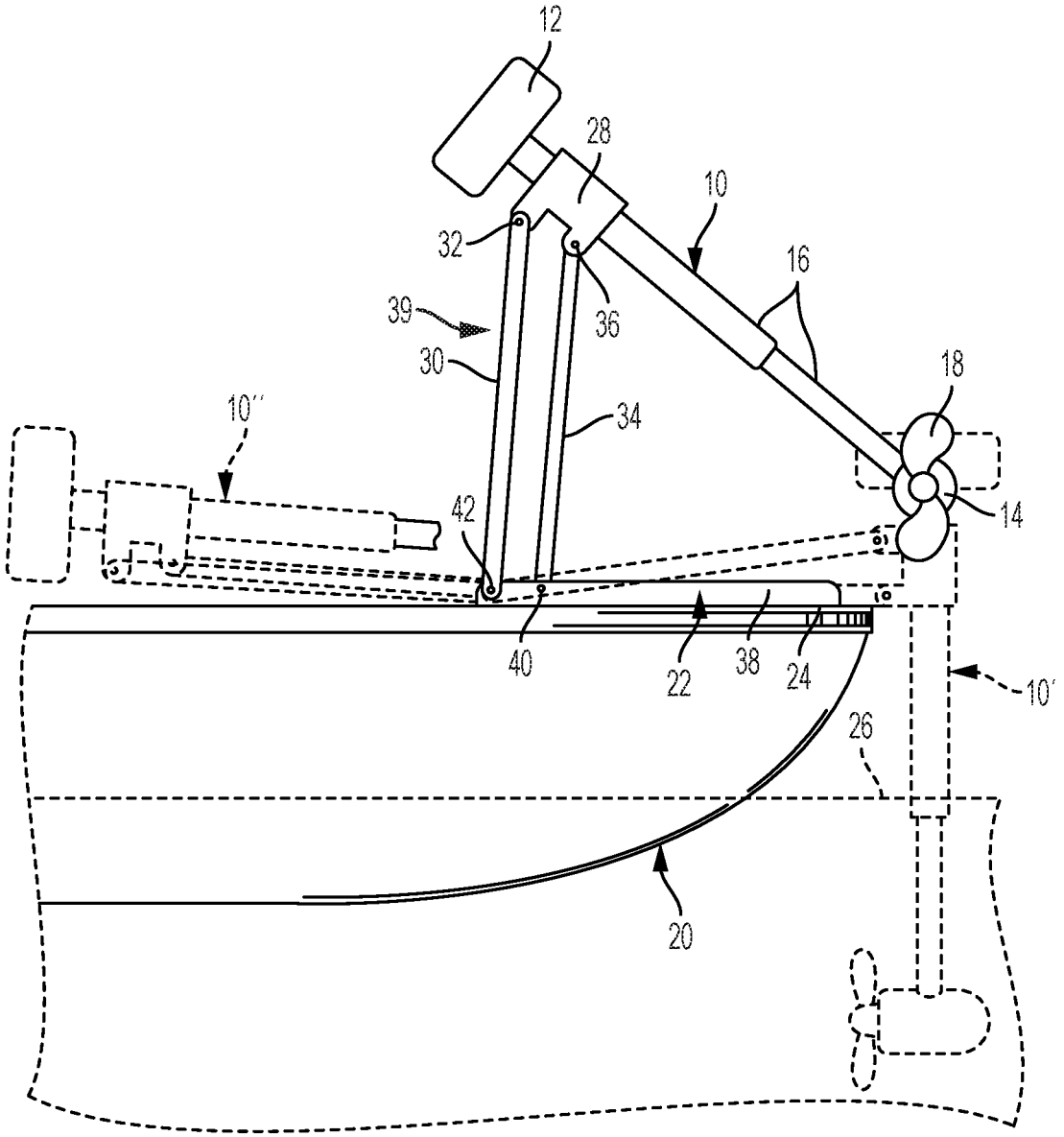
FIG. 1 PRIOR ART
FIG. 1 illustrates a trolling motor mounted to a watercraft according to one example of the prior art.

FIG. 1 illustrates a trolling motor 10 comprising a head unit 12, a propulsion unit 14, and a shaft 16 coupling the head unit 12 to the propulsion unit 14. The shaft 16 can be two parts as shown herein, or can be a single shaft extending between the head unit 12 and the propulsion unit 14. As is known, the propulsion unit 14 contains an electric motor that powers a propeller 18 in order to provide thrust to the watercraft 20 to which the trolling motor 10 is mounted. A mount 22 is configured to couple the shaft 16 to a deck 24 of the watercraft 20. More specifically, the trolling motor 10 includes a mount base 38 configured to be coupled to the deck 24 of the watercraft 20 and a shaft support 39 coupling the shaft 16 to the mount base 38. The shaft support 39 is pivotable with respect to the mount base 38 to move the trolling motor 10 between a deployed position, shown at 10', and a stowed position, shown at 10", with respect to the deck 24. In the stowed position, the trolling motor 10" lies generally parallel to the deck 24 of the watercraft 20 (i.e., horizontally), while in the deployed position, the trolling motor 10' is generally perpendicular to the deck 24 (i.e., vertical), and the propulsion unit 14 is located below the surface of the water 26.

In this example, the shaft support 39 comprises a four-pivot (four-bar) linkage including a bracket 28 holding the shaft 16, un upper arm 30 coupled to the bracket 28 at a first pivot 32, a lower arm 34 coupled to the bracket 28 at a second pivot 36, and a base 38 coupled to the lower arm 34 at a third pivot 40 and to the upper arm 30 at a fourth pivot 42. Such a four-pivot linkage-type mount 22 is known in the art for mounting trolling motors to bass fishing boats. Note, however, that a mount according to the present disclosure (to be described below) can be used with any type of trolling motor, including one having steering, speed, and direction controlled by a foot pedal, remote control, and/or tiller handle by way of mechanical and/or electronic signals. For example, the features of the present disclosure may alternatively be used with an electric trolling motor having a transmission housing pivotably coupled to a mount, which is in turn coupled to the deck 24 of the watercraft 20. One example of this type of trolling motor and mount is described in U.S. Pat. No. 9,969,474, which is hereby incorporated by reference herein. In such an example, the shaft support may be the transmission housing, through which the shaft extends.

No matter the type of mount, trolling motor, or how its steering and speed is controlled, pivoting of the trolling motor 10 between the stowed and deployed positions is useful as it allows an operator of the watercraft 20 to move the trolling motor 10 in and out of the water 26, such as when the operator is using a different propulsion device to move more quickly through the water 26, when the operator is storing the watercraft 20 at a dock or elsewhere, when the operator is servicing the motor or propeller 18 of the propulsion unit 14, when the watercraft 20 is loaded on a trailer, etc.

Figure 2:
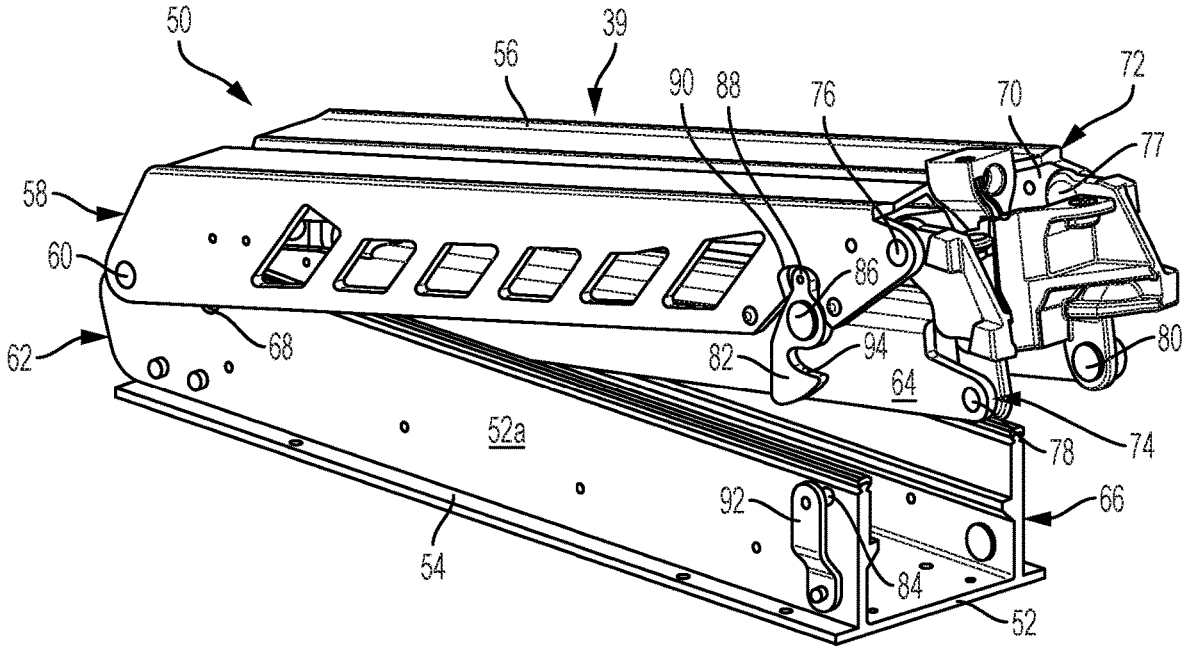
FIGS. 2 and 2A illustrate views of one example of a trolling motor mount according to the present disclosure.

Now turning to FIG. 2, one example of a mount 50 for a trolling motor 10 configured to pivot the trolling motor 10 between a deployed position (see 10', FIG. 1) and a stowed position (see 10", FIG. 1) is shown. The mount 50 includes a mount base 52 configured to be coupled to the deck 24 of a watercraft 20, such as by bolting through a flange 54. In this example, the shaft support 39 includes an upper arm 56 having a first end 58 pivotably coupled at pivot 60 to a first end 62 of the mount base 52. The shaft support 39 also includes a lower arm 64 having a first end (not visible here, see 98, FIG. 3) pivotably coupled at pivot 68 to the mount base 52 between the first end 62 of the mount base 52 and an opposite, second end 66 of the mount base 52. The shaft support 39 also includes a bracket 70 coupling an opposite, second end 72 of the upper arm 56 to an opposite, second end 74 of the lower arm 64. Here, the bracket 70 is coupled to the upper arm 56 at pivot 76 and to the lower arm 64 at pivot 78. Although not shown herein, the bracket 70 holds the shaft of the trolling motor. It should be understood from the drawings that the upper and lower arms 56, 64 have a width to them and are coupled at mirror-image pivots to both the bracket 70 and the base 52. For example, lower arm 64 is also coupled to bracket 70 at pivot 80, and upper arm 56 is also coupled to bracket 70 at pivot 77. When viewed from a side of the mount 50, pivot 80 is aligned with pivot 78 and pivot 77 is aligned with pivot 76, and the four pivots 76, 77, 78, 80 together allow pivoting of the upper arm 56 and lower arm 64 with respect to the bracket 70. Similar mirror-image pivots exist for pivots 60 and 68, as can be seen in FIG. 3.

In the example shown in FIG. 2, the mount 50 further comprises a deployed-position latch 82 coupled to the upper arm 56 and a corresponding deployed-position striker pin 84 coupled to the base 52 and configured to engage with the deployed-position latch 82 in the deployed position of the trolling motor 10' to lock the upper arm 56 to the base 52. Although the deployed-position latch 82 is shown as being coupled to the upper arm 56, note that the deployed-position latch 82 could instead be coupled to the base 52, in which case the deployed-position striker pin 84 would be coupled to the upper arm 56. The deployed-position latch 82 is coupled to the upper arm 56 at the second end 72 of the upper arm 56. More specifically, the deployed-position latch 82 is coupled to upper arm 56 at pivot 86 and includes a tab 88 located in a cutout 90 formed within upper arm 56. As deployed-position latch 82 rotates about pivot 86, it is prevented from moving more than a predetermined amount in either direction by engagement between tab 88 and cutout 90. The deployed-position striker pin 84 is coupled to the base 52 at the second end 66 of the base 52. More specifically, the deployed-position striker pin 84 is oriented generally perpendicularly with respect to a vertical wall **52*a* of the base 52, and is supported by a bracket 92, which may be bolted, welded, or otherwise connected to the vertical wall 52*a***.

Figure 2A:
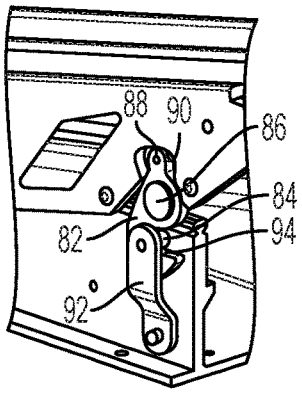

The deployed-position latch 82 is pivotable about pivot 86, as noted hereinabove, and is also spring-biased about this pivot 86 into a locked position. As shown in FIG. 2A, in the locked position, the deployed-position striker pin 84 is received in a latching recess 94 of the deployed-position latch 82 when the trolling motor is in the deployed position 10'. The spring bias can be provided by way of a torsion spring provided around pivot 86, by way of another type of biasing mechanism known to those having ordinary skill in the art, or by way of biasing a connector 122 coupled to the tab 88, as will be described herein below.

Figure 3:
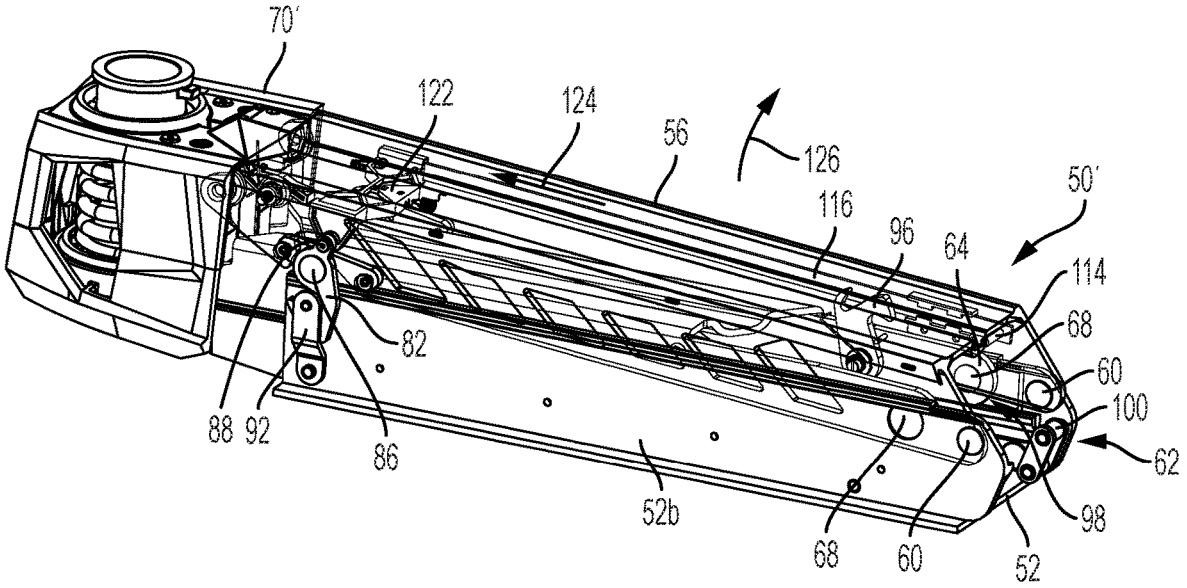
FIGS. 3, 3A, and 3B illustrate views of another example of a trolling motor mount according to the present disclosure.
Figure 3A:
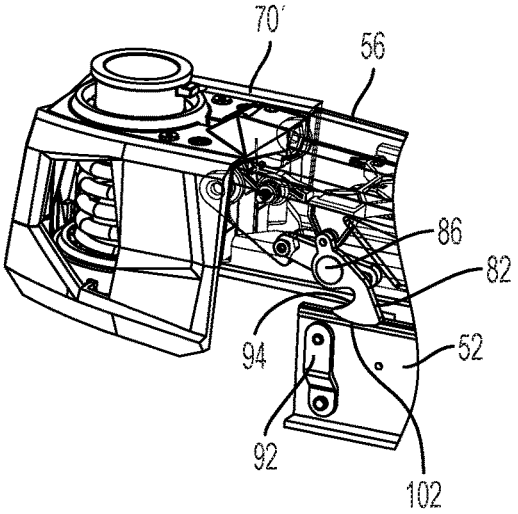
Figure 3B:
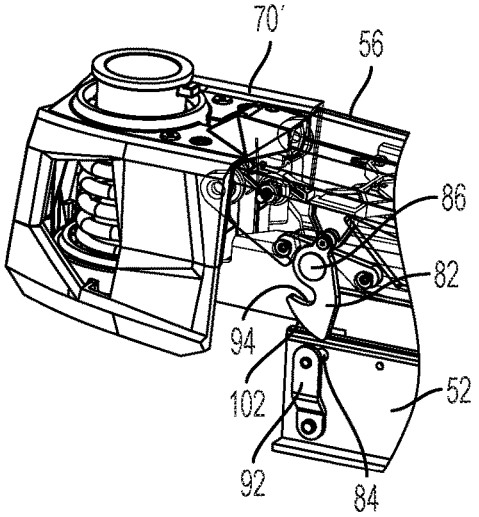

FIGS. 3, 3A, and 3B illustrate a mount 50' similar to the mount 50 of FIGS. 2 and 2A, except the bracket 70' is configured differently. All other components of the mount 50' are the same as those described with respect to the mount 50 and therefore will not be described in further detail. FIG. 3 does show, however, that a deployed-position latch 82 can additionally or alternatively be provided on an opposite side of the mount 50' for engagement with a deployed-position striker pin 84 held by bracket 92 on opposite vertical wall **52*b*. FIG. 3 also shows how the mount 50 or 50' may include a stowed-position latch 96 coupled to the lower arm 64 at the first end 98 of the lower arm 64. A corresponding stowed-position striker pin 100 is coupled to the base 52 at the first end 62 of the base 52 and is configured to engage with the stowed-position latch 96 in the stowed position of the trolling motor 10" to lock the lower arm 64 to the base 52, as will be described further herein below with respect to FIGS. 4, 4A, and 4B. Additionally, FIG. 3 shows how the pivots 60, 68 are provided on both sides of the upper and lower arms 56, 64**, as noted hereinabove.

Turning to FIGS. 3A and 3B, the spring-biased nature of the deployed-position latch 82 will be further described. The deployed-position latch 82 is shown in its spring-biased position in FIG. 3B. In this position, were the upper arm 56 to be lowered to its lowest extent into the deployed position of the trolling motor 10', the deployed-position striker pin 84 would be received in the latching recess 94 of the deployed-position latch 82. However, before the upper arm 56 can be lowered to its lowest extent, the deployed-position latch 82 must be pivoted from the position shown in FIG. 3B such that the deployed-position striker pin 84 can be received in the latching recess 94. For this purpose, the deployed-position latch 82 is provided with a sliding surface 102 configured to engage with the deployed-position striker pin 84 as the trolling motor 10 pivots into the deployed position. Such engagement is shown at FIG. 3A, and rotates the deployed-position latch 82 counterclockwise against the spring bias and into a receiving position, in which the deployed-position striker pin 84 can enter the latching recess 94. Upon full lowering of the upper arm 56, the deployed-position latch 82 will be rotated clockwise by the spring bias back into the locked position, and the deployed-position striker pin 84 will be fully received within the latching recess 94, as shown in FIG. 3.

Now turning to FIGS. 4, 4A, and 4B, details of the stowed-position latch 96 and stowed-position striker pin 100 will be described. The stowed-position latch 96 pivots about pivot 106 with respect to lower arm 64. The stowed-position latch 96 includes a latching recess 108, which is configured to receive the stowed-position striker pin 100. Such engagement of the latching recess 108 with the stowed-position striker pin 100 is shown in FIG. 4B. As the mount 50' is pivoted from the position shown in FIG. 4 to the position shown in FIG. 4A, a sliding surface 110 on the stowed-position latch 96 engages with the stowed-position striker pin 100, and rotates the stowed-position latch 96 about pivot 106 against a spring bias, which may for example be provided by a torsion spring, into a receiving position, in which the latching recess 108 is able to receive the stowed-position striker pin 100. The stowed-position striker pin 100 is shown at the beginning of this travel at one end of sliding surface 110 in FIG. 4, and at the end of this travel at the other end of sliding surface 110 in FIG. 4A, which represents the receiving position. Once the sliding surface 110 is no longer engaged with the stowed-position striker pin 100, the spring bias rotates the stowed-position latch 96 into a locked position, as shown in FIG. 4B. In this position, the stowed-position striker pin 100 is fully received in the latching recess 108.

Figure 4:
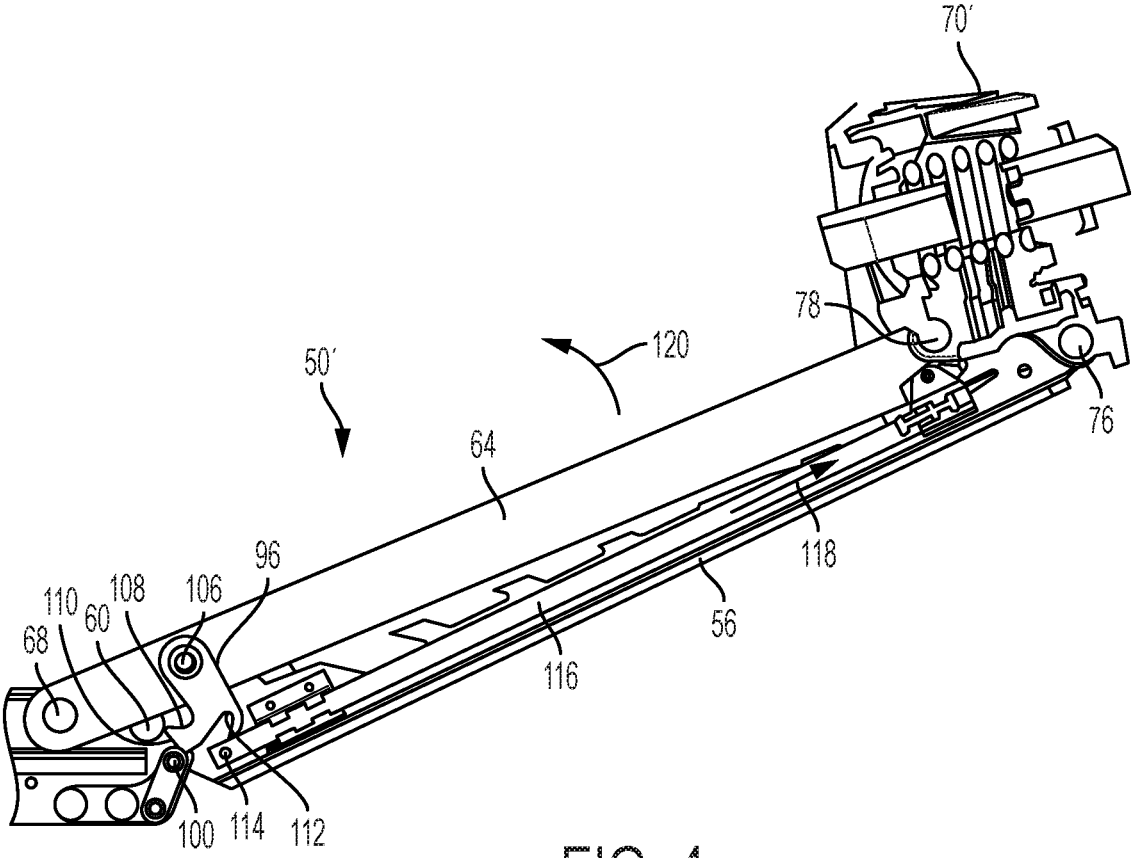
FIGS. 4, 4A, and 4B illustrate additional views of the mount of FIG. 3.
Figure 4A:
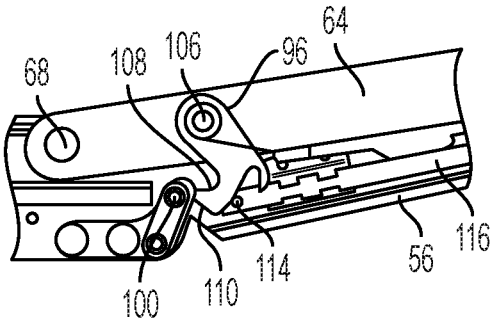
Figure 4B:
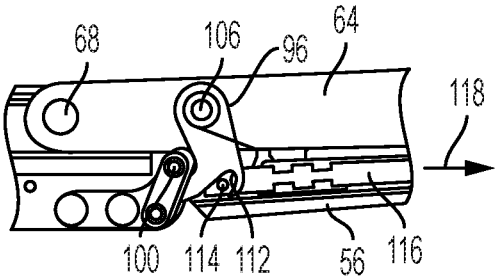

Also of note in FIGS. 4, 4A, and 4B is that the stowed-position latch 96 includes another recess 112, which is configured to receive a release pin 114. The release pin 114 is provided at one end of a release mechanism 116, here in the form of a rod or bar, which can be used to release the stowed-position latch 96 from the locked position shown in FIG. 4B. To actuate the release mechanism 116, the release mechanism 116 is pulled in the direction of arrow 118 by way of a cord or other user-operated device connected to the release mechanism 116, which movement causes the release pin 114 to engage with the inner end of recess 112 on stowed-position latch 96. Further movement in the direction of arrow 118 forces the release pin 114 against the inner end of recess 112, which pivots the stowed-position latch 96 counterclockwise out of the locked position, disengaging the stowed-position striker pin 100 and latching recess 108 from one another. Such release thereafter allows the upper and lower arms 56, 64 to be rotated in the direction of arrow 120, back into the deployed position.

Referring back to FIG. 3, it should be noted that the release mechanism 116, when actuated, is configured to disengage both the deployed-position latch 82 from the deployed-position striker pin 84 and the stowed-position latch 96 from the stowed-position striker pin 100. Disengagement of the stowed-position latch 96 was previously described above. The release mechanism 116 is able to release the deployed-position latch 82 from the deployed-position striker pin 84 by way of a connector 122 extending laterally across the mount 50' just below the surface of upper arm 56. In an example in which two deployed-position latches are provided, one side of the connector 122 is coupled to the tab 88 on the deployed-position latch 82 on one lateral side of the mount 50', and the other side of the connector 122 is coupled to the tab 88 on the deployed-position latch 82 on the other lateral side of the mount 50'. The connector 122 is also coupled to one end of the release mechanism 116. When the release mechanism 116 is pulled in the direction of arrow 124, this causes the connector 122 also to move in the direction of arrow 124, thereby pivoting the tab(s) 88 within the cutout(s) 90 toward the bracket 70'. Such pivoting is about pivot 86 and rotates the deployed-position latch 82 counterclockwise against its spring bias, disengaging the latching recess 94 from the deployed-position striker pin 84, as shown in FIG. 3A. Once these two surfaces have been disengaged, as shown in FIG. 3B, the mount 50' is able to be rotated in the direction of arrow 126 toward the stowed position.

Thus, the same release mechanism 116 can be used to release both the stowed and deployed-position latches 96, 82. A single cord, pull handle, lever, or similar device can be used to actuate the release mechanism 116. In alternative embodiments, the release mechanism 116 could be a cord or a wire, instead of a rod as shown herein. Also note that instead of providing a torsion spring at pivot 86, deployed-position latch 82 could be biased by way of a spring connected to connector 122, which would tend to pull the connector 122 away from the bracket 70', thereby biasing the deployed-position latch 82 into the above-noted locked position.

Through research and development, the present inventors have discovered that trolling motors traditionally have been difficult for the consumer to stow and deploy due to the weight of the system. The present inventors have thus developed a spring and damper combination for aiding the entire lifting and stowing motion and the entire lifting and deploying motion, which requires balancing of the spring force and damping force in the correct orientation. The mount 50, 50' of the present disclosure provides lift assist during deployed-to-stowed actuation and during stowed-to-deployed actuation. Such lift assist can be provided with a single gas spring. The present inventors have determined a kinematic location for the gas spring that allows the load of the trolling motor 10 in the stowed position to balance with the load of the trolling motor 10 in the deployed position. Additionally, the gas spring's location and the provision of damping in the gas spring allow the trolling motor 10 to fall gently into the deployed position and into the stowed position. Thus, the present mount 50, 50' allows for soft deploy action and soft stowing action along with lift assist during both stowing and deploying actuation.

Figure 5:
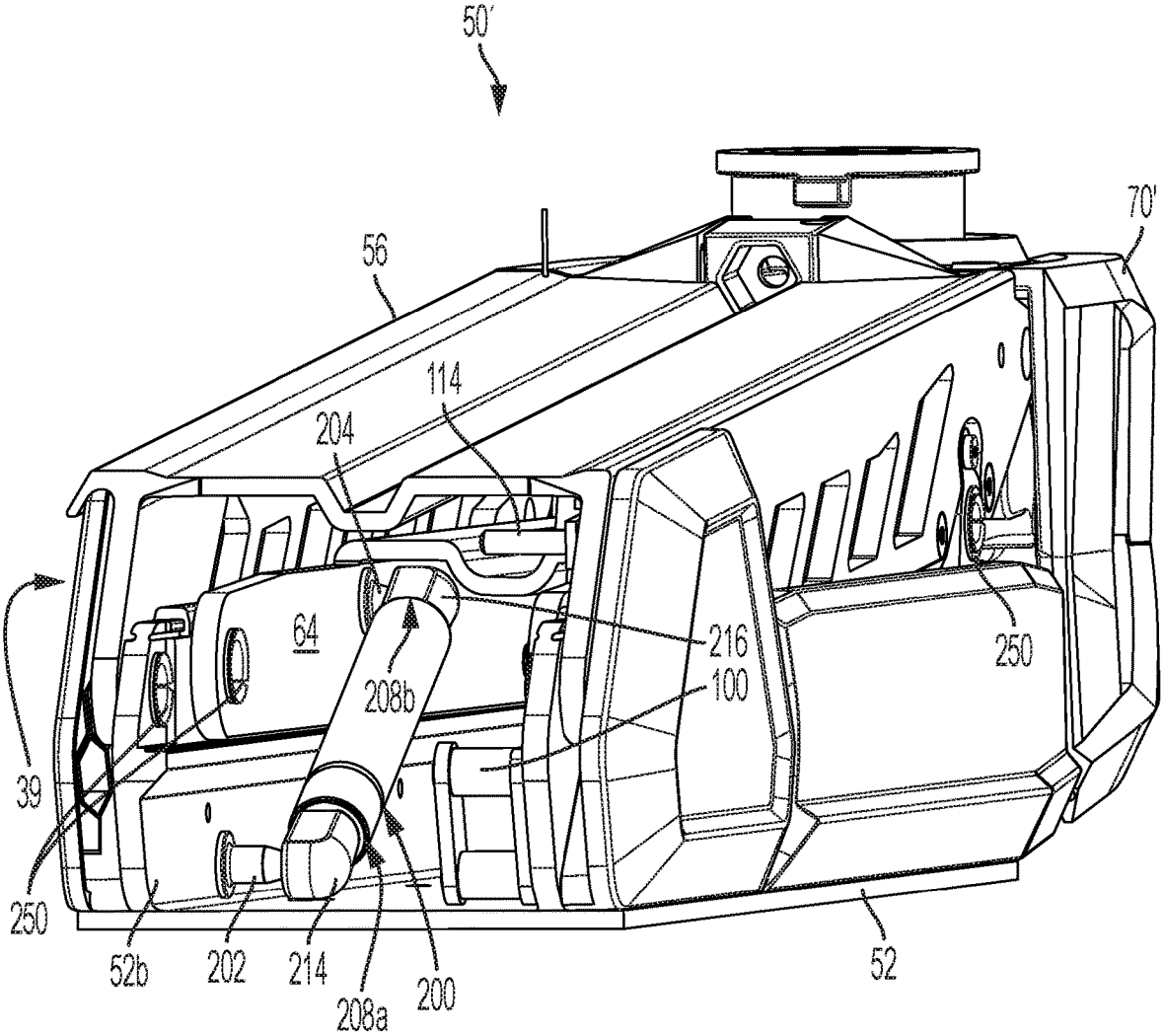
FIG. 5 is a rear perspective view of the mount of FIG. 3.

Turning to FIG. 5, the mount 50' of the present disclosure includes a spring and damper combination 200 coupled between one of the upper or lower arm 56, 64 and the base 52. In this example, the spring and damper combination 200 is coupled between the lower arm 64 and the base 52, at vertical wall 52*b*, by way of pins 202, 204. However, the spring and damper combination 200 could be coupled between the upper arm 56 and the vertical wall 52*b*, between the upper arm 56 and another portion of the base 52, or between the lower arm 64 and another portion of the base 52. Also note that the spring and damper combination 200 described herein could be used with the mount 50 of FIG. 2 or with the mount 22 of FIG. 1.

Figure 6:
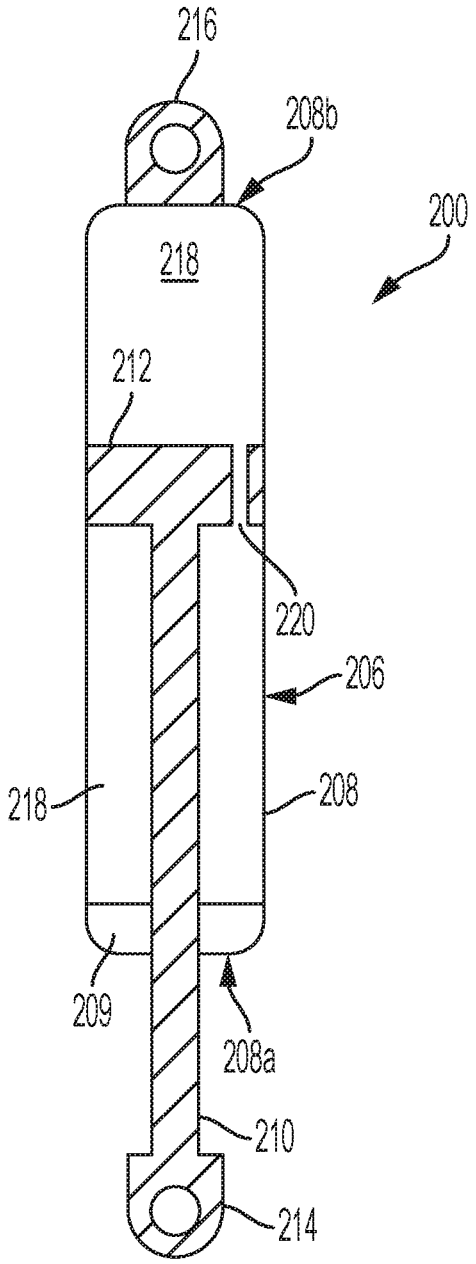
FIG. 6 is a schematic of a gas spring for use with the mount of the present disclosure.

Referring to FIG. 6, in one example, the spring and damper combination 200 is a single gas spring 206 with damping. The gas spring 206 comprises a cylinder 208 with a rod 210 extending through one end 208*a* thereof, and is sealed with an end plug 209. A piston 212 is coupled to the end of the rod 210 that is located within the cylinder 208. The opposite end of the rod 210 is located outside the cylinder 208, and includes an end fitting 214 for receiving the pin 202, which is for example connected to the vertical wall 52*b* of the base 52. An end fitting 216 is provided at an opposite end 208*b* of the cylinder 208 as well, for receiving the pin 204, which is for example connected to the lower arm 64. In the present example, as will be described herein below, a spring portion of the spring and damper combination 200 provides a spring force to assist in lifting the one of the upper or lower arm 56, 64 away from the deck 24, and a damper portion of the spring and damper combination 200 provides a damping force to slow lowering of the one of the upper or lower arm 56, 64 towards the deck 24.

Regarding the spring portion of the spring and damper combination 200, the cylinder 208 is filled with a pressurized gas 218, such as but not limited to nitrogen, the flow of which is controlled by a passageway (nozzle, valve, or orifice) 220 extending through the piston 212. As the piston 212 is pushed further into the cylinder 208 (i.e., further toward the end 208*b*), the rod 210 takes up more room and compresses the gas 218 within the cylinder 208. This stores potential energy in the gas spring 206. Here, according to the orientation of the ends 208*a*, 208*b* of the cylinder 208 and the rod 210 of the gas spring 206 shown in FIG. 5, maximum potential energy is stored when the mount 50' is pivoted such that the trolling motor 10 is in the fully deployed position and when the mount 50' is pivoted such that the trolling motor 10 is in the fully stowed position. In the fully deployed position, the rod 210 is fully compressed within the cylinder 208. In the fully stowed position, the rod 210 is partially compressed within the cylinder 208. The spring and damper combination 200 is positioned in such a way that it balances the required efforts to move the mount 50' from the deployed position to the stowed position and from the stowed position to the deployed position.

Such potential energy is released, as a spring force, when the trolling motor 10 is pivoted from the deployed or stowed position to a pivot position representing a balance point between the deployed and stowed positions, during which time the piston 212 moves toward the end 208*a* of cylinder 208. In this balanced position, the upper arm 56 of the mount 50' is angled at somewhere between 120 and 130 degrees with respect to the base 52. The balanced position can also be defined as (but is not limited to) a position at which the spring and damper combination 200 intersects with pivot 60 or pivot 68, depending on whether the spring and damper combination 200 is coupled to the upper arm 56 or the lower arm 64 (see FIG. 11B). Thus, the spring portion (cylinder 208, rod 210, piston 212, gas 218) provides a spring force (i.e., releases stored potential energy) to assist in lifting the one of the upper or lower arm 56, 64 away from the deck 24 both while the trolling motor 10 is pivoted from the deployed position to the stowed position (at least until the mount 50' reaches the balanced position) and while the trolling motor 10 is pivoted from the stowed position to the deployed position (at least until the mount 50' reaches the balanced position).

Regarding the damper portion, the gas spring 206 may have inherent damping provided by way of sizing of the passageway 220 in the piston 212. Restriction of flow of the gas 218 through this passageway 220 ensures that the piston 212 and rod 210 can move at only a predetermined rate depending on the size of the passageway 220, the weight of the trolling motor 10 and mount 50', and the external force applied by the operator lifting or lowering the trolling motor 10. According to the orientation of the gas spring 206 in FIG. 5, as the piston 212 moves closer to the end 208*b* of the cylinder 208, while being lowered into the stowed or deployed position, gas 218 travels at a controlled rate through the passageway 220 (and, in some examples, around the piston 212) to softly lower the trolling motor 10 into the deployed or stowed position. Thus, the damper portion (cylinder 208, piston 212, gas 218, passageway 220) provides a damping force to slow lowering of the one of the upper or lower arm 56, 64 towards the deck 24 both while the trolling motor 10 is pivoted from the deployed position to the stowed position and while the trolling motor 10 is pivoted from the stowed position to the deployed position. More specifically, such damping is provided as the trolling motor 10 is lowered from the approximate balanced position to the stowed position and as the trolling motor 10 is lowered from the approximate balanced position to the deployed position.

Figure 7:
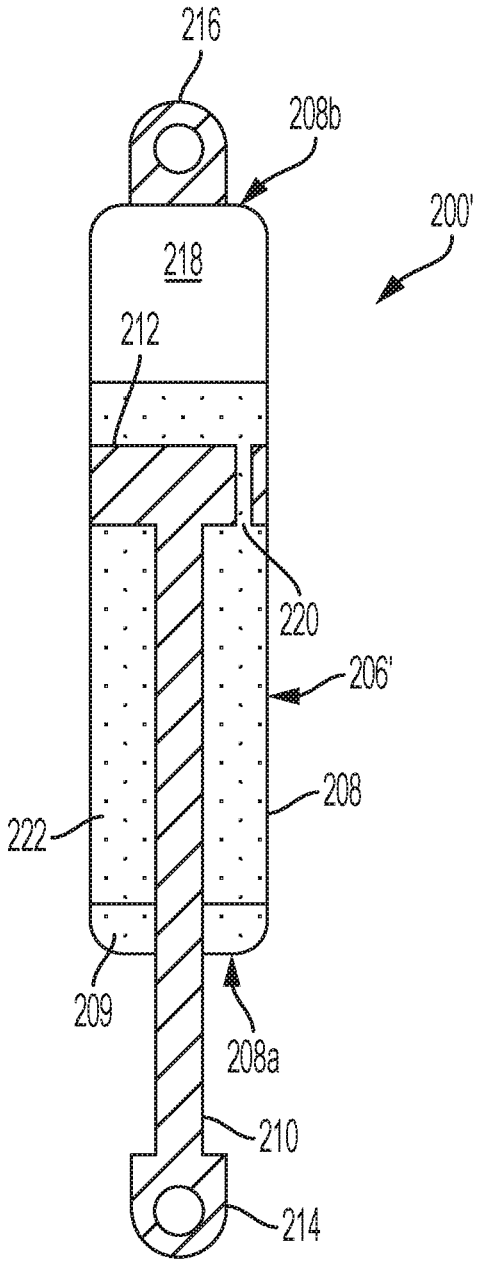
FIG. 7 is a schematic of another gas spring for use with the mount of the present disclosure.

FIG. 7 schematically shows another example of a gas spring 206' provided with additional damping by way of a hydraulic fluid 222, such as but not limited to oil, within the cylinder 208. The hydraulic fluid 222 is part of the damper portion of the gas spring 206' and limits the rate at which the piston 212 can travel both while the rod 210 retracts into and is pulled out of the cylinder 208. Thus, in the spring and damper combination 200' shown in FIG. 7, the spring force of the gas spring 206' is a controlled drive force dependent at least in part on the viscosity of the hydraulic fluid 222. Although the example shown herein is of a fully damped gas spring 206', a partially damped gas spring (with damping provided by hydraulic fluid only at one end of travel of the rod 210 or the other) could instead be used.

Figure 8:
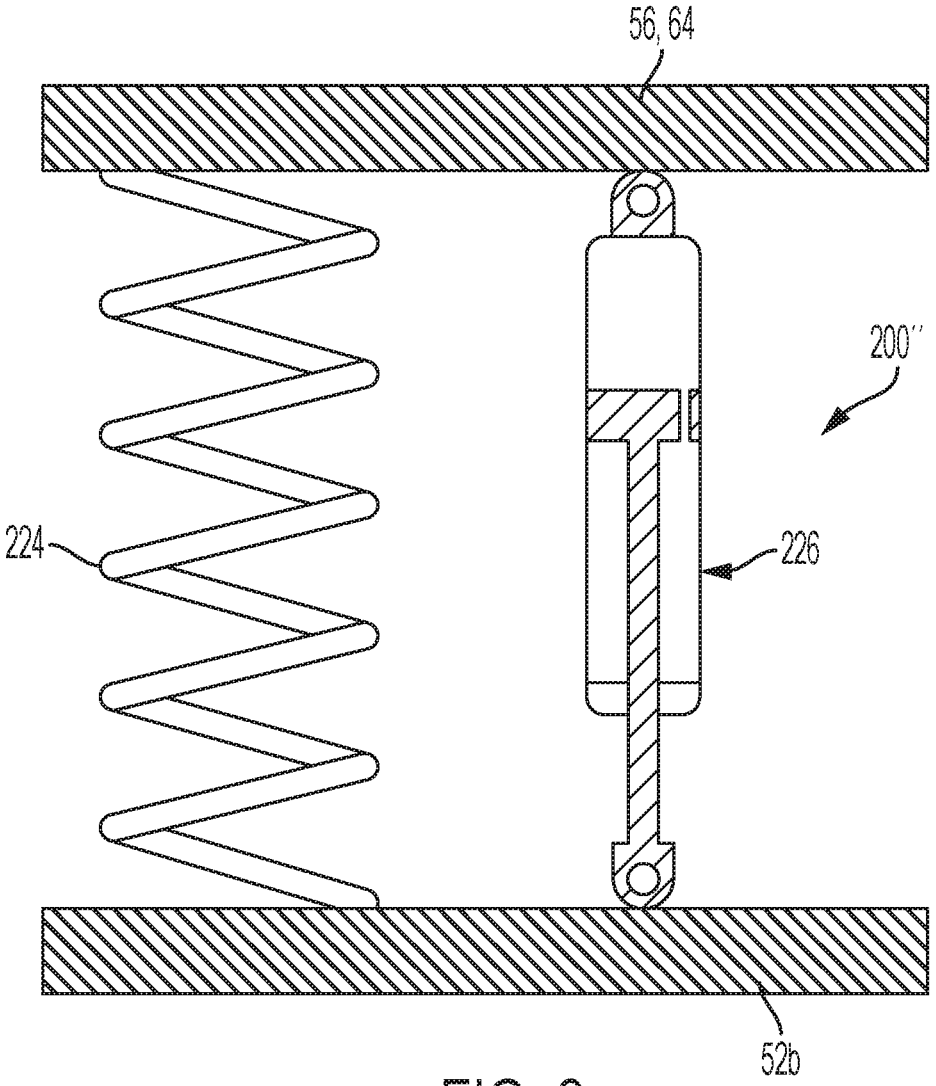
FIG. 8 is a schematic of a compression spring and damper for use with the mount of the present disclosure.

The examples of FIGS. 6 and 7 illustrate spring and damper combinations 200, 200' comprising single gas springs 206, 206' with damping. In another example, as shown in FIG. 8, the spring portion of a spring and damper combination 200" comprises a compression spring 224, and the damper portion comprises a rotary or linear damper 226. The damper 226 could be a hydraulic or pneumatic damper. Alternatively, the damper 226 could comprise magnetorheological fluid that changes viscosity based on a nearby magnetic field. The compression spring 224 stores potential energy when it is in its compressed state, e.g., when the trolling motor 10 is fully stowed or fully deployed. While being lifted out of the fully stowed or fully deployed position toward the balanced position, the compression spring 224 releases its potential energy to urge the upper or lower arm 56, 64 away from the deck 24 of the watercraft 20. The damper 226 can be configured to provide damping only while the trolling motor 10 is lowered from the balanced position into the stowed or deployed position, or can also provide damping as the trolling motor 10 is lifted toward the balanced position.

In the examples of FIGS. 5-7, note that the spring and damper combination 200, 200' remains coupled to both the lower arm 64 and to the base 52 throughout pivoting of the trolling motor 10 between the deployed and stowed positions. This coupling throughout pivoting ensures that the spring force is provided both when lifting the trolling motor 10 from the deployed position to the balanced position and when lifting the trolling motor 10 from the stowed position to the balanced position. This coupling throughout pivoting also ensures that damping force is provided both when lowering the trolling motor 10 from the balanced position to the deployed position and when lowering the trolling motor 10 from the balanced position to the stowed position. In the example of FIG. 8, the compression spring 224 and the damper 226 may also remain coupled to both the lower arm 64 and to the base 52 throughout pivoting of the trolling motor 10 between the deployed and stowed positions. Alternatively, the compression spring 224 might only be coupled between the upper or lower arm 56, 64 and the base 52 from the stowed/deployed position to the balanced position, and/or the damper 226 might only be coupled between the upper or lower arm 56, 64 and the base 52 from the balanced position to the stowed/deployed position.

Figure 11A:
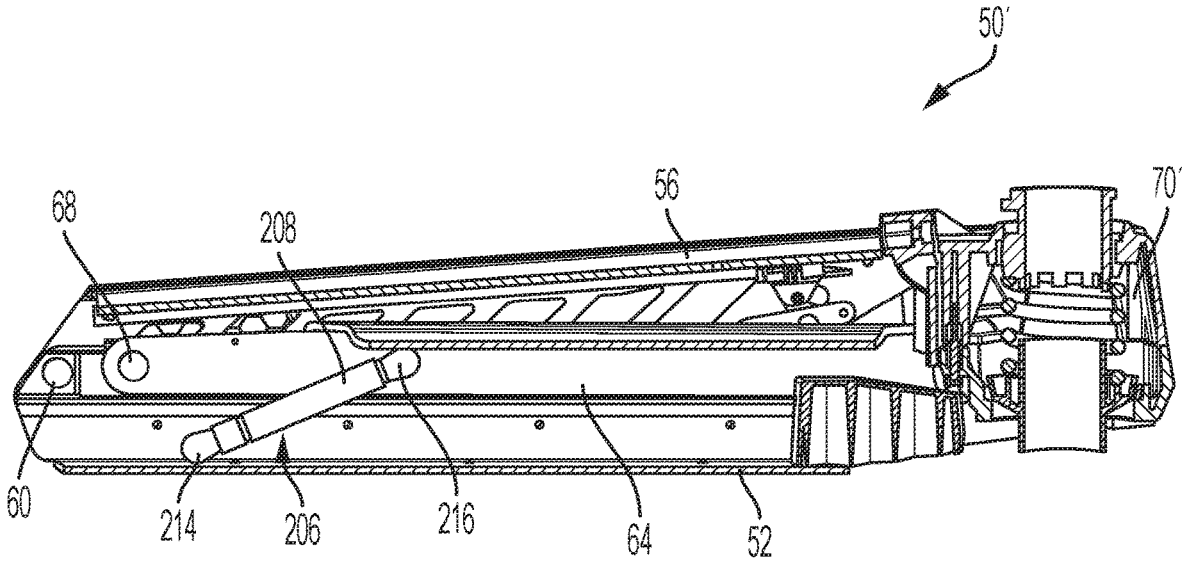
FIGS. 11A, 11B, and 11C show the mount of FIGS. 3 and 4 in various positions.
Figure 11B:
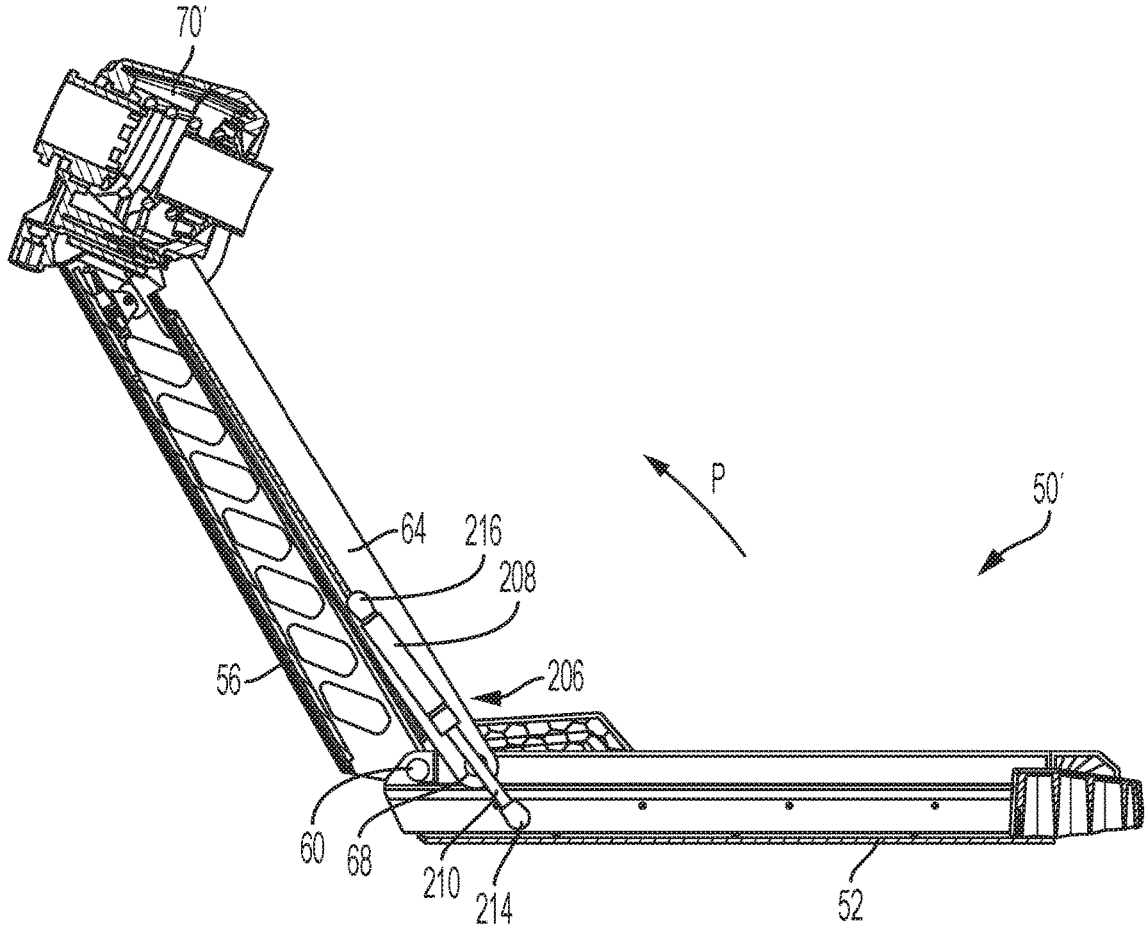
Figure 11C:
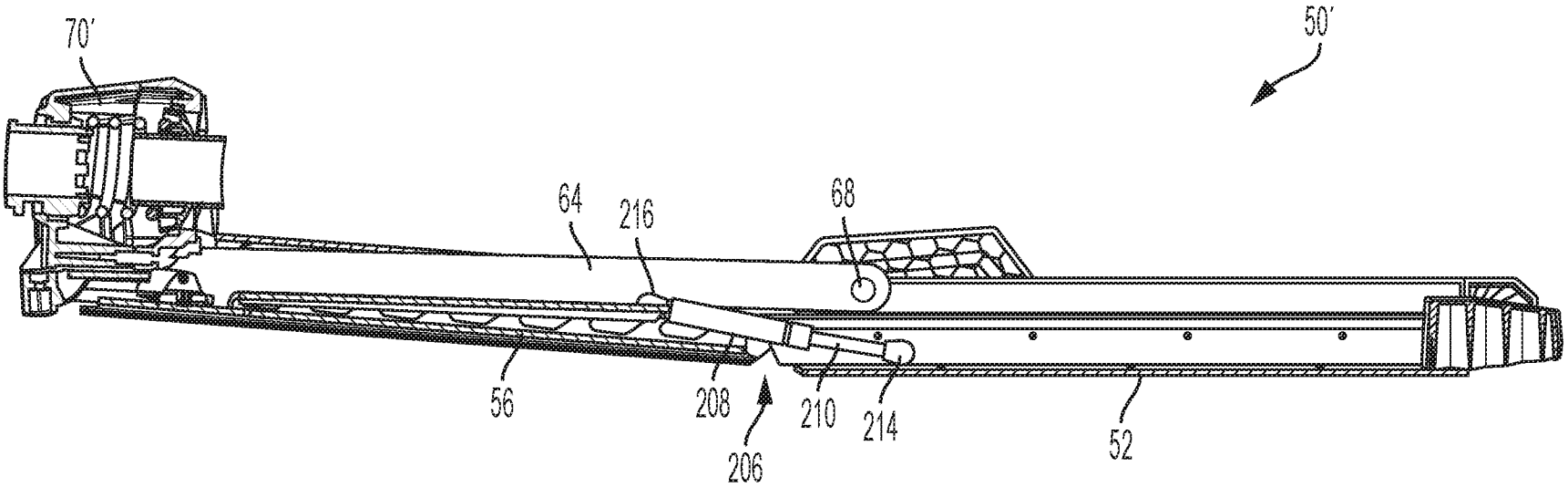

By way of example, refer briefly to FIGS. 11A-C, where the mount 50' is shown schematically in different positions. In FIG. 11A, the mount 50' is in a position in which the trolling motor 10 would be fully deployed, with the upper and lower arms 56, 64 folded over the base 52. The cylinder 208 of the gas spring 206 is shown connecting the lower arm 64 to the base 52, but it should be understood that the cylinder 208 could instead be connected between the upper arm 56 and the base 52. Very little (in this example, none) of the rod 210 is visible, as the rod 210 is retracted within the cylinder 208. As the upper and lower arms 56, 64 are pivoted in the direction of arrow P (FIG. 11B), the points where the cylinder 208 and rod 210 are connected to the lower arm 64 and to the base 52, respectively, (e.g., at pins 202, 204, FIG. 5) become further away from one another. This causes progressively more of the rod 210 to extend out of the cylinder 208, as the gas spring 206 is connected between the upper or lower arm 56, 64 and the base 52 at all pivotable positions, and potential energy is released.

FIG. 11B shows the mount 50' in the approximate balanced position, with at least a portion of the rod 210 extended from the cylinder 208. Note that the full extension of the rod 210 from the cylinder 208 might occur at +/−10 degrees from the 120-degree position shown here, depending on the location of the pivots 60, 68 between the upper and lower arms 56, 64 and the base 52 and depending on the locations of the connection points of the gas spring 206 to the upper or lower arm 56, 64 and to the base 52 and the dimensions of the gas spring 206. Note also that the gas spring 206 is shown intersecting (or aligned with) the pivot 68, indicating that the kinematics of the assembly are balanced. If the gas spring 206 were instead connected to the upper arm 56, the balanced position would be one in which the gas spring 206 intersected (or aligned with) the pivot 60.

FIG. 11C then shows how, in the position in which the trolling motor 10 is fully stowed, the rod 210 has been partially retracted into the cylinder 208, with damping provided during such retraction, as described herein above. The kinematics of the gas spring 206 work in reverse as the mount 50' is pivoted from the stowed position of FIG. 11C, through the balanced position of FIG. 11B, to the deployed position of FIG. 11A.

Note that although the mount 50' is shown in the schematics of FIGS. 11A-C with the gas spring 206, the same kinematic description applies to the mount 22 or 50 and to the gas spring 206'.

Because fishermen generally desire minimal noise for optimal fishing, trolling motors have traditionally created challenges for the user when they develop creaking and knocking noises as the motor is turned on and off. These noises are generated by the gradual loosening of pivots in the mount structure that are loaded in a repetitive manner. Bow mount trolling motors currently use a variety of pivot materials, but typically the pivots are a stainless steel pin or rivet in a plastic bushing. While plastic bushings are quiet initially, as the plastic wears, it eventually becomes loose and makes noise. Many plastic resin varieties have been used, but the plastic is not intended for the loads a typical bow mount trolling motor applies to the pivots. Other non-plastic bushings can be used, but a lubricant must continually be applied to maintain stiffness at the pivots. When the lubricant washes away from a non-plastic bushing, the mount becomes noisy, and reapplication of the lubricant is difficult and bothersome. To solve these problems, the present inventors have provided the trolling motor 10 with metal-reinforced, self-lubricating bearings 250 (FIG. 5) pivotably coupling the shaft support 39 to the mount base 52. Although only three bearings 250 are shown in FIG. 5, it should be understood that similar bearings can be provided at some or all of the pivots 60, 68, 76, 77, 78, 80, and/or 86 described hereinabove. Thus according to the present disclosure, at least one metal-reinforced, self-lubricating bearing 250 pivotably couples at least one of the upper and lower arms 56, 64 to at least one of the base 52 and the bracket 70, 70'. Additionally, note that the bearings 250 could be used with the mount 22 or the mount 50 shown in FIGS. 1 and 2, respectively.

In one example, the bearings 250 of the present disclosure are metal-reinforced, self-lubricating bearings with a layer of low friction polytetrafluoroethylene (PTFE) (e.g., TEFLON™). This type of bearing can have a metal-reinforced back made of materials including, but not limited to, stainless steel, aluminum, or carbon steel. The bearings can have a single flange, a double flange (see FIG. 9), or no flange. The flanged style provides additional support between the mating components at each pivot. The metal-reinforced self-lubricating bearings 250 provide the tight and long-lasting feel of a metal bearing without the need for continual re-lubrication, while the low friction PTFE provides the feel of a plastic bearing without the wearing associated therewith.

Figure 9:
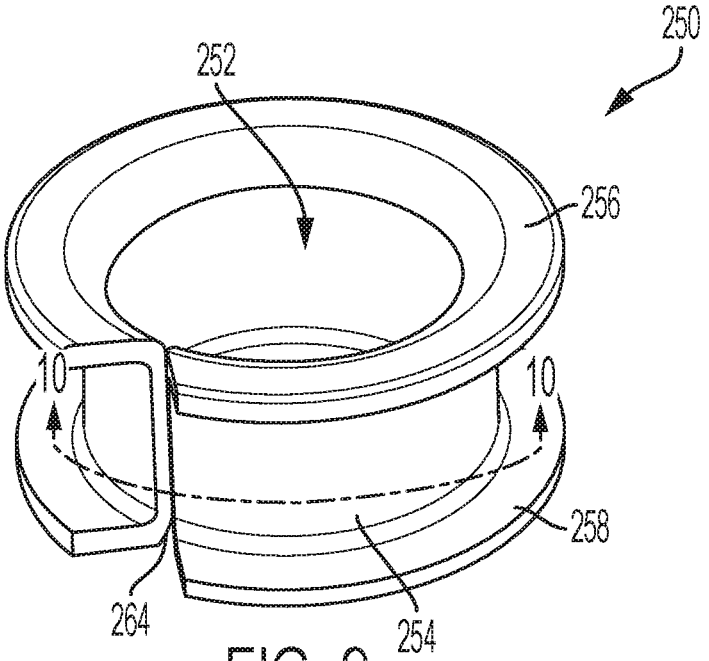
FIG. 9 illustrates a bearing for a pivot pin on the mount of the present disclosure.
Figure 10:
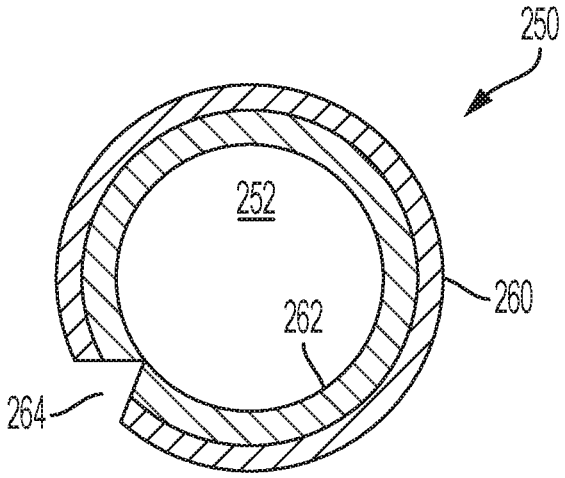
FIG. 10 is a schematic cross section of the bearing of FIG. 9.

In the example of the bearing 250 shown in FIGS. 9 and 10, the bearing 250 is a bushing having a cylindrical opening 252 defined by a cylindrical wall 254. At either end of the wall 254, a flange 256, 258 is provided. The opening 252 is sized to hold a pivot pin (not shown) extending through the two or more components in the mount 50' that are connected at the pivot in question. The outer surface of the wall 254 is in contact with the inner surface of a hole bored, molded, or otherwise formed in the mount components. As shown in FIG. 10, the bearing 250 includes a metal backing 260 with an outer layer of polytetrafluorethylene (PTFE) 262. A slit 264 can be provided in the bearing 250 in order to allow the bearing 250 to adjust to the size of the pin inserted in the opening 252 and to the size of the hole in which the bearing 250 is inserted. Due to the slit 264 and the material of which the bearing 250 is made, the bearing 250 is flexible and can be interference fit with the pin and the components of the mount which it connects. Clearance is not needed, unlike in prior art designs, due to this flexible interference fit, which results in a tighter connection at the pivots and therefore less movement, wear, and resulting noise. In one example, the bearings 250 are NORGLIDE™ bearings provided by Saint-Gobain, but other brands and types of bearings could be used.

The present disclosure therefore is of a trolling motor 10 that comprises at least one of the following: (a) a spring and damper combination 200, 200', 200" coupled between the mount base 52 and the shaft support 39, wherein a spring portion (cylinder 208, rod 210, piston 212, gas 218) of the spring and damper combination 200, 200', 200" provides a spring force to assist in pivoting the shaft support 39 away from the deck 24, and a damper portion (cylinder 208, piston 212, gas 218, passageway 220, optionally hydraulic fluid 222) of the spring and damper combination 200, 200', 200" provides a damping force to slow pivoting of the shaft support 39 towards the deck 24; and (b) a metal-reinforced, self-lubricating bearing 250 pivotably coupling the shaft support 39 to the mount base 52. Either one of these features, or the two in combination, provide the mount 22, 50, 50' with much smoother, quieter operation as it moves to pivot the trolling motor 10 between the stowed and deployed positions. As noted herein above, the spring portion of the spring and damper combination 200, 200', 200" provides the spring force to assist in pivoting the shaft support 39 away from the deck 24 while the trolling motor 10 is pivoted from the deployed position to the stowed position (at least until the balanced position) and while the trolling motor 10 is pivoted from the stowed position to the deployed position (at least until the balanced position). The damper portion provides the damping force to slow pivoting of the shaft support 39 towards the deck 24 while the trolling motor 10 is pivoted from the deployed position to the stowed position (at least from the balanced position) and while the trolling motor 10 is pivoted from the stowed position to the deployed position (at least from the balanced position). The spring and damper combination 200, 200', 200" remains coupled to both the mount base 52 and the shaft support 39 throughout pivoting of the trolling motor 10 between the deployed and stowed positions, providing easy lifting and soft lowering both from and to the stowed and deployed positions. Meanwhile, the metal-reinforced, self-lubricating bearings 250 provide smooth pivoting of the mount components with respect to one another. The bearings 250 do not wear nearly as quickly as traditional plastic bearings, nor do they require continual re-lubrication like traditional metal bearings. Thus, the smooth, quiet fit between mount components is maintained for a longer time than with prior art assemblies.

In the present description, certain terms have been used for brevity, clarity, and understanding. No unnecessary limitations are to be implied therefrom beyond the requirement of the prior art because such terms are used for descriptive purposes only and are intended to be broadly construed. The different systems described herein may be used alone or in combination with other systems. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

What is claimed is:

1. A trolling motor comprising:

a head unit;

a propulsion unit;

a shaft coupling the head unit to the propulsion unit;

a mount base configured to be coupled to a deck of a watercraft; and a shaft support coupling the shaft to the mount base;

wherein the shaft support is pivotable with respect to the mount base to move the trolling motor between a deployed position and a stowed position with respect to the deck; and wherein the trolling motor further comprises at least one of the following:

a spring and damper combination coupled between the mount base and the shaft support, wherein a spring portion of the spring and damper combination provides a spring force to assist in pivoting the shaft support away from the deck, and a damper portion of the spring and damper combination provides a damping force to slow pivoting of the shaft support towards the deck; and a metal-reinforced, self-lubricating bearing pivotably coupling the shaft support to the mount base;

wherein the trolling motor comprises the spring and damper combination; and wherein the spring portion provides the spring force to assist in pivoting the shaft support away from the deck while the trolling motor is pivoted from the deployed position to the stowed position and while the trolling motor is pivoted from the stowed position to the deployed position.

2. The trolling motor of claim 1, wherein the trolling motor comprises the spring and damper combination; and wherein the damper portion provides the damping force to slow pivoting of the shaft support towards the deck while the trolling motor is pivoted from the deployed position to the stowed position and while the trolling motor is pivoted from the stowed position to the deployed position.

3. The trolling motor of claim 1, wherein the shaft support comprises:

an upper arm having a first end pivotably coupled to a first end of the mount base;

a lower arm having a first end pivotably coupled to the mount base between the first end of the mount base and an opposite, second end of the mount base; and a bracket coupling an opposite, second end of the upper arm to an opposite, second end of the lower arm;

wherein the bracket holds the shaft of the trolling motor.

4. The trolling motor of claim 3, wherein the trolling motor comprises the spring and damper combination; and wherein the spring and damper combination is coupled between the lower arm and the mount base.

5. The trolling motor of claim 1, wherein the trolling motor comprises the spring and damper combination; and wherein the spring and damper combination remains coupled to both the mount base and the shaft support throughout pivoting of the trolling motor between the deployed and stowed positions.

6. The trolling motor of claim 1, wherein the trolling motor comprises the spring and damper combination; and wherein the spring and damper combination is a single gas spring with damping.

7. The trolling motor of claim 1, wherein the trolling motor comprises the spring and damper combination;

wherein the spring portion comprises a compression spring; and wherein the damper portion comprises a rotary or linear damper.

8. The trolling motor of claim 1, wherein the trolling motor comprises the bearing, and wherein the bearing is a bushing.

9. The trolling motor of claim 8, wherein the bearing comprises a metal backing with an outer layer of polytetrafluoroethylene.

10. A mount for coupling a trolling motor to a deck of watercraft and configured to pivot the trolling motor between a deployed position and a stowed position with respect to the deck, the mount comprising:

a base configured to be coupled to the deck;

an upper arm having a first end pivotably coupled to a first end of the base;

a lower arm having a first end pivotably coupled to the base between the first end of the base and an opposite, second end of the base;

a bracket coupling an opposite, second end of the upper arm to an opposite, second end of the lower arm; and a spring and damper combination coupled between one of the upper or lower arm and the base, wherein a spring portion of the spring and damper combination provides a spring force to assist in lifting the one of the upper or lower arm away from the deck, and a damper portion of the spring and damper combination provides a damping force to slow lowering of the one of the upper or lower arm towards the deck;

wherein the spring portion provides the spring force to assist in lifting the one of the upper or lower arm away from the deck while the trolling motor is pivoted from the deployed position to the stowed position and while the trolling motor is pivoted from the stowed position to the deployed position.

11. The mount of claim 10, wherein the damper portion provides the damping force to slow lowering of the one of the upper or lower arm towards the deck while the trolling motor is pivoted from the deployed position to the stowed position and while the trolling motor is pivoted from the stowed position to the deployed position.

12. The mount of claim 10, wherein the spring and damper combination is coupled between the lower arm and the base.

13. The mount of claim 12, wherein the spring and damper combination remains coupled to both the lower arm and to the base throughout pivoting of the trolling motor between the deployed and stowed positions.

14. The mount of claim 10, wherein the spring and damper combination is a single gas spring with damping.

15. The mount of claim 10, wherein the spring portion comprises a compression spring and the damper portion comprises a rotary or linear damper.

16. The mount of claim 10, further comprising at least one metal-reinforced, self-lubricating bearing pivotably coupling at least one of the upper and lower arms to at least one of the base and the bracket.

17. The mount of claim 16, wherein the at least one bearing is a bushing.

18. The mount of claim 16, wherein the at least one bearing comprises a metal backing with an outer layer of polytetrafluoroethylene.

19. A trolling motor comprising:

a head unit;

a propulsion unit;

a shaft coupling the head unit to the propulsion unit;

a mount base configured to be coupled to a deck of a watercraft;

a shaft support coupling the shaft to the mount base, wherein the shaft support is pivotable with respect to the mount base to move the trolling motor between a deployed position and a stowed position with respect to the deck; and a spring and damper combination connected between the mount base and the shaft support, wherein a spring portion of the spring and damper combination provides a spring force to assist in pivoting the shaft support away from the deck, and a damper portion of the spring and damper combination provides a damping force to slow pivoting of the shaft support towards the deck;

wherein the spring and damper combination has a first end connected to the mount base and an opposite second end connected to the shaft support, and both of the first and second ends remain connected to the mount base and the shaft support, respectively, throughout pivoting of the trolling motor between the deployed and stowed positions.

20. A trolling motor comprising:

a head unit;

a propulsion unit;

a shaft coupling the head unit to the propulsion unit;

a mount base configured to be coupled to a deck of a watercraft; and a shaft support coupling the shaft to the mount base, wherein the shaft support is pivotable with respect to the mount base to move the trolling motor between a deployed position and a stowed position with respect to the deck; and a spring and damper combination coupled between the mount base and the shaft support, wherein a spring portion of the spring and damper combination provides a spring force to assist in pivoting the shaft support away from the deck, and a damper portion of the spring and damper combination provides a damping force to slow pivoting of the shaft support towards the deck;

wherein the damper portion provides the damping force to slow pivoting of the shaft support towards the deck while the trolling motor is pivoted from the deployed position to the stowed position and while the trolling motor is pivoted from the stowed position to the deployed position.

* * * * *